US011628105B2

(12) United States Patent
Villarreal Suarez

(10) Patent No.: US 11,628,105 B2
(45) Date of Patent: Apr. 18, 2023

(54) POWERED WHEELCHAIRS AND METHODS FOR MAINTAINING A POWERED WHEELCHAIR IN A PRE-SELECTED POSITION

(71) Applicant: Toyota Motor North America, Inc., Plano, TX (US)

(72) Inventor: Dario Jose Villarreal Suarez, Farmers Branch, TX (US)

(73) Assignee: TOYOTA MOTOR NORTH AMERICA, INC., Plano, TX (US)

( * ) Notice: Subject to any disclaimer, the term of this patent is extended or adjusted under 35 U.S.C. 154(b) by 498 days.

(21) Appl. No.: 16/911,863

(22) Filed: Jun. 25, 2020

(65) Prior Publication Data

US 2021/0401641 A1 Dec. 30, 2021

(51) Int. Cl.
*A61G 5/10* (2006.01)
*A61G 5/04* (2013.01)

(52) U.S. Cl.
CPC ..... *A61G 5/104* (2013.01); *A61G 5/04* (2013.01)

(58) Field of Classification Search
CPC . A61G 5/104; A61G 5/04; A61G 5/06; A61G 5/1081
See application file for complete search history.

(56) References Cited

U.S. PATENT DOCUMENTS 6,202,773 B1 3/2001 Richey, II et al.
7,974,753 B2 7/2011 Kuo et al.
2008/0133089 A1 6/2008 Bayomy et al.
2017/0189250 A1 7/2017 Juhasz
2020/0121526 A1* 4/2020 Cooper ..... A61G 5/1075

FOREIGN PATENT DOCUMENTS

CN 203493840 U 3/2014
CN 204562615 U 8/2015
CN 206534797 U 10/2017
(Continued)

OTHER PUBLICATIONS

Evaluation of different gyroscope sensors for smart wheelchair applications (https://www.sciencedirect.com/science/article/pii/S1877705811010381) Jul. 26, 2011.
(Continued)

*Primary Examiner* — Michael V Kerrigan
(74) *Attorney, Agent, or Firm* — Dinsmore & Shohl LLP

(57) ABSTRACT

A powered wheelchair includes a seat, a first leg, a second leg, and a control unit. The first leg includes a first inertial measurement unit configured to determine a position of the first leg and a first leg actuator configured to adjust a position of the first leg. The second leg includes a second inertial measurement unit configured to determine a position of the second leg and a second leg actuator configured to adjust a position of the second leg. The control unit is operable to determine a global orientation of the powered wheelchair by averaging the position of first leg and the position of the second leg, and automatically adjusting the position of the first leg with a first leg actuator and the position of the second leg with the second leg actuator based on the global orientation to maintain the seat in a pre-selected position.

20 Claims, 5 Drawing Sheets

(56) References Cited

FOREIGN PATENT DOCUMENTS

| | | | |
|---|---|---|---|
| CN | 107647981 | A | 2/2018 |
| CN | 107233168 | B | 5/2018 |
| CN | 108042276 | A | 5/2018 |
| CN | 207412322 | U | 5/2018 |
| CN | 106420202 | B | 6/2018 |
| CN | 107757793 | B | 3/2019 |
| CN | 209751430 | U | 12/2019 |
| CN | 210158811 | U | 3/2020 |
| JP | 2017213189 | A | 12/2017 |
| KR | 101269876 | B1 | 6/2013 |
| WO | 2020047847 | A1 | 3/2020 |

OTHER PUBLICATIONS

Development and evaluation of a gyroscope-based wheel rotation monitor for manual wheelchair users (https://www.ncbi.nlm.nih.gov/pmc/articles/PMC3758531/) Jul. 2013.

* cited by examiner

POWERED WHEELCHAIRS AND METHODS FOR MAINTAINING A POWERED WHEELCHAIR IN A PRE-SELECTED POSITION

TECHNICAL FIELD

The present specification generally relates to powered wheelchairs and methods and, more specifically, powered wheelchairs and methods for maintaining a seat of a powered wheelchair in a pre-selected position.

BACKGROUND

Powered wheelchairs may generally be navigated by a user manipulating a joystick or similar user interface device. Oftentimes, as a user traverses an uneven surface with the powered wheelchair, the user's center of gravity may shift away from the center of the seat.

Accordingly, a need exists for powered wheelchairs and methods for maintaining a seat of a powered wheelchair in a pre-selected position.

SUMMARY

In embodiments, a powered wheelchair includes a seat, a first leg located at a first side of the powered wheelchair, a second leg located at a second side of the powered wheelchair, and a control unit. The first leg includes a first inertial measurement unit configured to determine a position of the first leg and a first leg actuator configured to adjust a position of the first leg. The second leg includes a second inertial measurement unit configured to determine a position of the second leg and a second leg actuator configured to adjust a position of the second leg. The control unit may be operable to determine a global orientation of the powered wheelchair by averaging the position of first leg provided by the first inertial measurement unit and the position of the second leg provided by the second inertial measurement unit, and automatically adjust the position of the first leg with the first leg actuator and the position of the second leg with the second leg actuator based on the global orientation of the powered wheelchair such that the seat may be maintained in a pre-selected position.

In one or more embodiments, a method for maintaining a seat of a powered wheelchair in a pre-selected position is included. The method includes receiving, with a control unit, a position of a first leg located at a first side of the powered wheelchair as determined by a first inertial measurement unit. The method further includes receiving, with the control unit, a position of a second leg located at a second side of the powered wheelchair as determined by a second inertial measurement unit. The method further includes determining, with the control unit, a global orientation of the powered wheelchair by averaging the position of first leg provided by the first inertial measurement unit and the position of the second leg provided by the second inertial measurement unit. The method further includes automatically adjusting, with the control unit, at least one of the first leg of the powered wheelchair and the second leg of the powered wheelchair with one or more actuators to maintain the seat in the pre-selected position.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
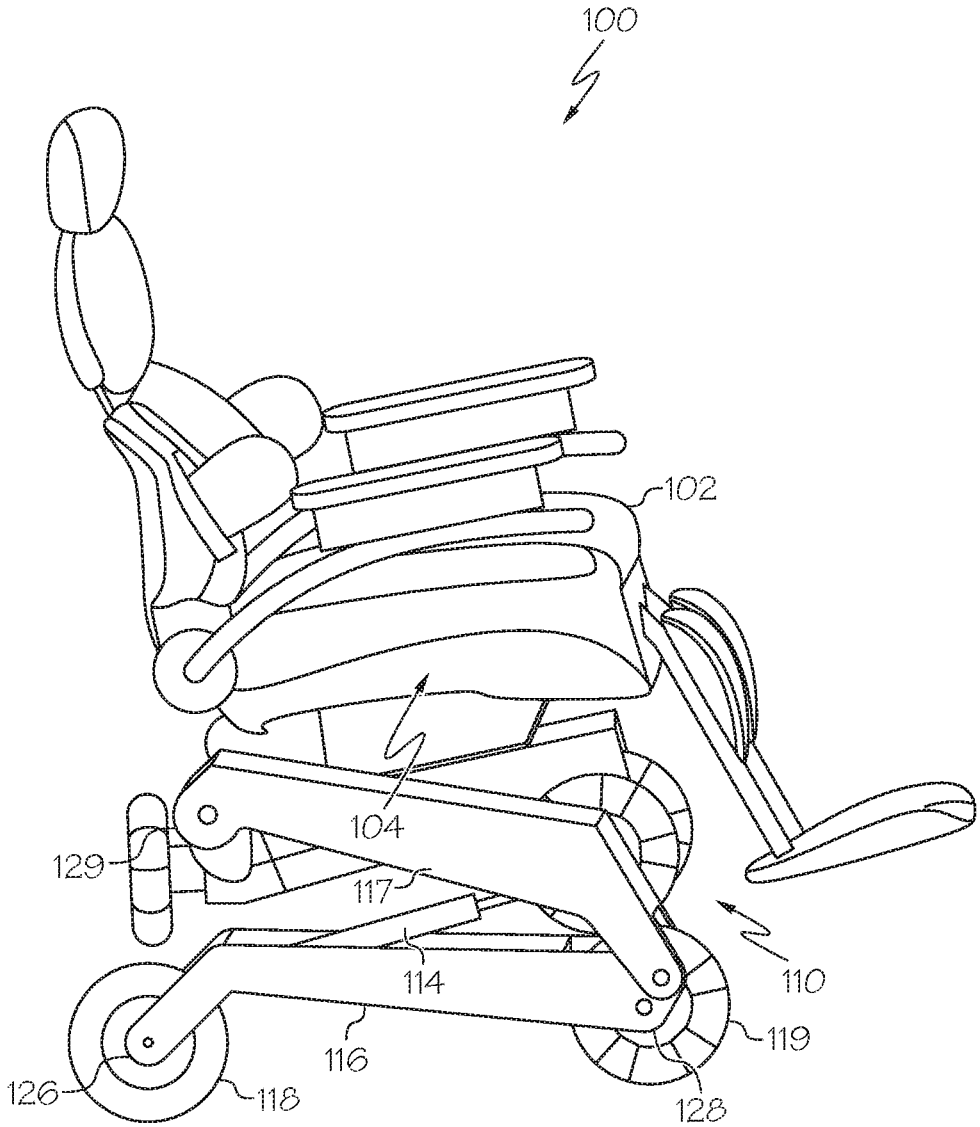
FIG. 1 depicts a side view of a powered wheelchair, according to one or more embodiments shown and described herein.

Embodiments of the present disclosure are directed to powered wheelchairs and methods for maintaining a seat of the powered wheelchair in a pre-selected position. For example, when a powered wheelchair is traversing uneven terrain, the powered wheelchair may tilt forward, backward, or laterally, thereby shifting a user's body (e.g., the user's center of gravity) into an uncomfortable position. The shifting of the user's center of gravity may also result in the user falling out of the powered wheelchair or an overturning of the powered wheelchair. With this understanding, the present embodiments are configured to determine a global orientation of the powered wheelchair and to automatically adjust the position of one or more legs of the powered wheelchair such that the powered wheelchair's seat is maintained in a pre-selected position. Various embodiments of powered wheelchairs and methods for maintaining a seat of a powered wheelchair in a pre-selected position will be described in more detail herein.

Referring now to FIGS. 1 and 3A-3C, which depict various views of a powered wheelchair 100, according to one or more embodiments shown and described herein. The powered wheelchair 100 may include a seat 102, configured to support a user 200. The powered wheelchair 100 may further include a first leg 110 located at a first side 104 of the powered wheelchair 100 and a second leg 120 located at a second side 106 of the powered wheelchair 100. Each leg 110, 120 may include one or more wheels, e.g., powered via a motor, not shown. For example, in the illustrated embodiment, each leg 110, 120 includes a lower leg linkage 116 to which a first wheel 118 and a second wheel 119 are pivotally coupled such that the first wheel 118 and the second wheel 119 may rotate to move the powered wheelchair 100 across a surface 170. The first wheel 118 may be coupled to a distal end 126 of the lower leg linkage 116 while the second wheel 119 may be coupled to a proximal end 128 of the lower leg linkage 116. The lower leg linkage 116 may be pivotally coupled to an upper leg linkage 117 at the proximal end 128 of the lower leg linkage 116. A proximal end 129 of the upper leg linkage 117 may be pivotally coupled to the seat 102.

One or more actuators may be configured to move the upper leg linkage 117 relative to the lower leg linkage 116 about the proximal end 128 of the lower leg linkage 116. For example, the one or more actuators may include a first leg actuator 114 and a second leg actuator 124, schematically illustrated in FIG. 2. The one or more leg actuators 114, 124 may include any combination of linear or rotational actuators, configured to adjust the angle of the upper leg linkage 117 in the side to side and/or the forward to aft directions.

The powered wheelchair 100 may further include a control unit 140, which will be more fully described below in relation to FIG. 2. The control unit may be operable to determine a global orientation of the powered wheelchair 100 by averaging the position of first leg 110 provided by the first inertial measurement unit 112 and the position of the second leg 120 provided by the second inertial measurement unit 122. The control unit may further be operable to automatically adjust the position of the first leg 110 and the position of the second leg 120 based on the global orientation of the powered wheelchair 100 such that the seat 102 of the powered wheelchair 100 may be maintained in a pre-selected position.

Figure 2:
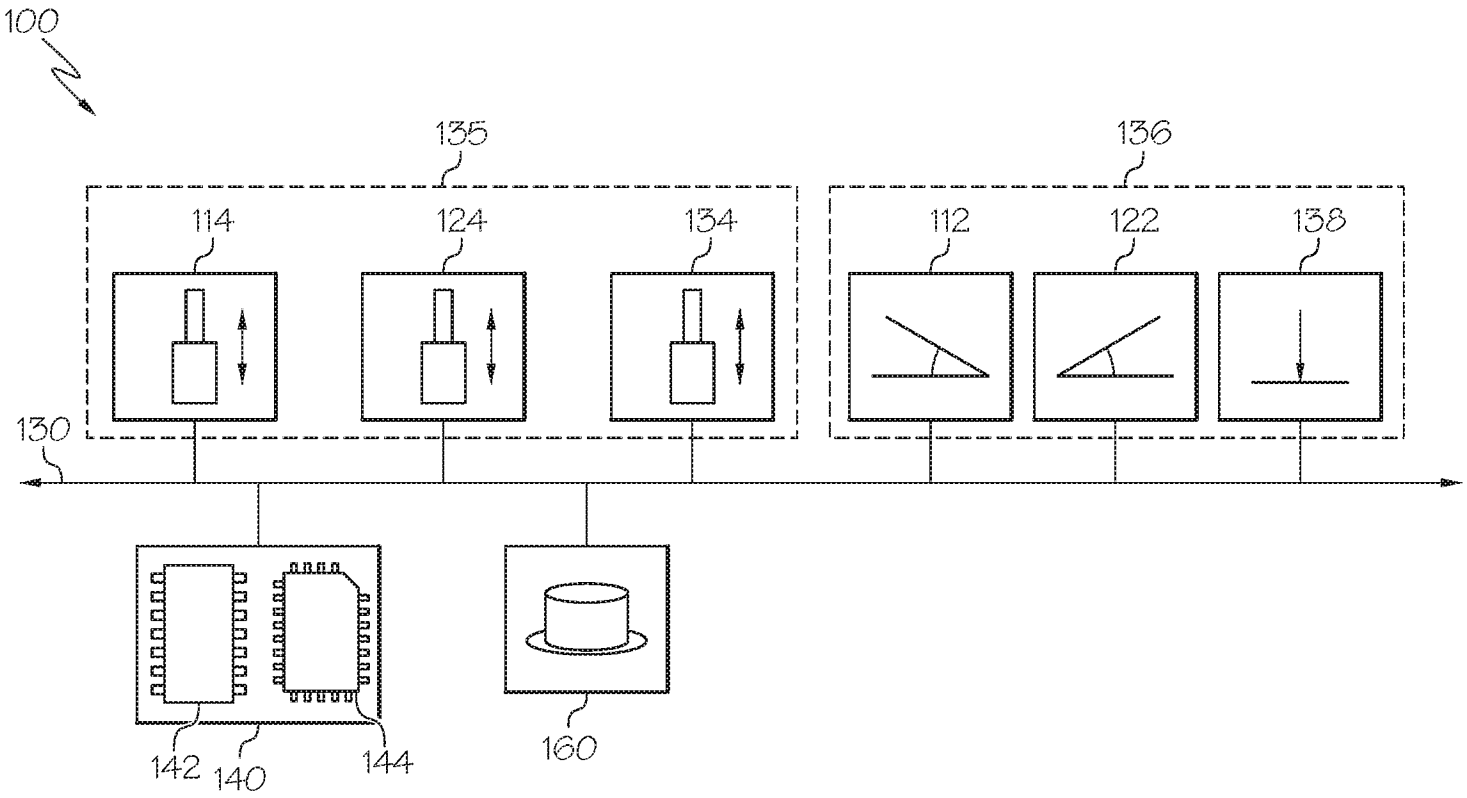
FIG. 2 schematically depicts various communicatively coupled modules of the powered wheelchair of FIG. 1, according to one or more embodiments shown and described herein.

FIG. 2 schematically depicts various modules of a powered wheelchair 100, according to one or more embodiments shown and described herein. A fewer or greater number of modules may be included without departing from the scope of the present disclosure. Generally, the powered wheelchair 100 may include a communication path 130; a control unit 140; one or more actuators 135, which may include a first leg actuator 114, a second leg actuator 124, and a seat actuator 134; one or more sensing units 136, which may include a first inertial measurement unit 112, a second inertial measurement unit 122, one or more force sensing units 138, and/or any other sensing units that may output a signal indicative of the powered wheelchair 100; and one or more user interface devices 160.

The communication path 130 provides data interconnectivity between various modules disposed within the powered wheelchair 100. Specifically, each of the modules can operate as a node that may send and/or receive data. In one or more embodiments, the communication path 130 may include a conductive material that permits the transmission of electrical data signals to and between processors, memories, sensors, and valves, pumps, etc. throughout the powered wheelchair 100. In embodiments, the communication path 130 can be a bus, such as for example a LIN bus, a CAN bus, a VAN bus, and the like. In further embodiments, the communication path 130 may be wireless and/or an optical waveguide. Components that are communicatively coupled may include components capable of exchanging data signals with one another such as, for example, electrical signals via conductive medium, electromagnetic signals via air, optical signals via optical waveguides, and the like.

The control unit 140 may be configured to selectively operate components of the powered wheelchair 100. For example, the control unit 140 may control the first leg actuator 114, the second leg actuator 124, and the seat actuator 134 to automatically adjust the position of the first leg 110, the position of the second leg 120, and the position of the seat 102 based on the global orientation of the powered wheelchair such that the seat 102 of the powered wheelchair 100 may be maintained in a pre-selected position. For example, the control unit 140 may include one or more processors 142 and one or more memory modules 144.

The one or more processors 142 may include any device capable of executing machine-readable instructions stored on the one or more memory modules. Accordingly, each processor may include a controller, an integrated circuit, a microchip, a computer, and/or any other computing device. It is noted that the one or more processors 142 may reside within the powered wheelchair 100 and/or external to the powered wheelchair 100.

The one or more memory modules 144 may be communicatively coupled to the one or more processors 142 over the communication path 130. The one or more memory modules 144 may be configured as volatile and/or nonvolatile memory and, as such, may include random access memory (including SRAM, DRAM, and/or other types of RAM), flash memory, secure digital (SD) memory, registers, compact discs (CD), digital versatile discs (DVD), and/or other types of non-transitory computer-readable mediums. Depending on the particular embodiment, these non-transitory computer-readable mediums may reside within the powered wheelchair 100 and/or external to the powered wheelchair 100.

Embodiments of the present disclosure include logic stored on the one or more memory modules 144 that includes machine-readable instructions and/or an algorithm written in any programming language of any generation (e.g., 1GL, 2GL, 3GL, 4GL, and/or 5GL) such as, machine language that may be directly executed by the one or more processors 142, assembly language, obstacle-oriented programming (OOP), scripting languages, microcode, etc., that may be compiled or assembled into machine readable instructions and stored on a machine readable medium. Similarly, the logic and/or algorithm may be written in a hardware description language (HDL), such as logic implemented via either a field-programmable gate array (FPGA) configuration or an application-specific integrated circuit (ASIC), and their equivalents. Accordingly, the logic may be implemented in any conventional computer programming language, as pre-programmed hardware elements, and/or as a combination of hardware and software components. As will be described in greater detail herein, logic stored on the one or more memory modules 144 allows the control unit 140 to, for example, to determine a global orientation of the powered wheelchair 100 by averaging the position of first leg 110 provided by the first inertial measurement unit 112 and the position of the second leg 120 provided by the second inertial measurement unit 122, and automatically adjust the position of the first leg 110, the position of the second leg 120, and the position of the seat 102 based on the global orientation of the powered wheelchair 110 such that the seat 102 may be maintained in a pre-selected position.

The first and second leg actuators 114, 124 and the seat actuator 134 may be communicatively coupled to the control unit 140 over the communication path 130. As will be described below, the control unit 140 may execute logic to control a position of the first and second leg actuators 114, 124 to automatically adjust the position of the first leg 110 and the position of the second leg 120 based on the global orientation of the powered wheelchair 100 such that the seat 102 may be maintained in a pre-selected position.

The one or more sensing units 136 are communicatively coupled to the control unit 140 over the communication path 130. The first inertial measurement unit 112 and the second inertial measurement unit 122 may include any sensing units configured to output a position of the first leg 110 and the second leg 120, respectively. For example, the first and second inertial measurement units 112, 122 may include a combination of one or more gyroscopes and one or more accelerometers. As such, the first inertial measurement unit 112 and the second inertial measurement unit 122 may indicate that the powered wheelchair 100 is traveling over an uneven surface 170 based on the tilt of the first leg 110 and the second leg 120, respectively. However, it should be understood that the first and second inertial measurement units 112, 122 are not limited to any particular type of inertial measurement unit.

Figure 3A:
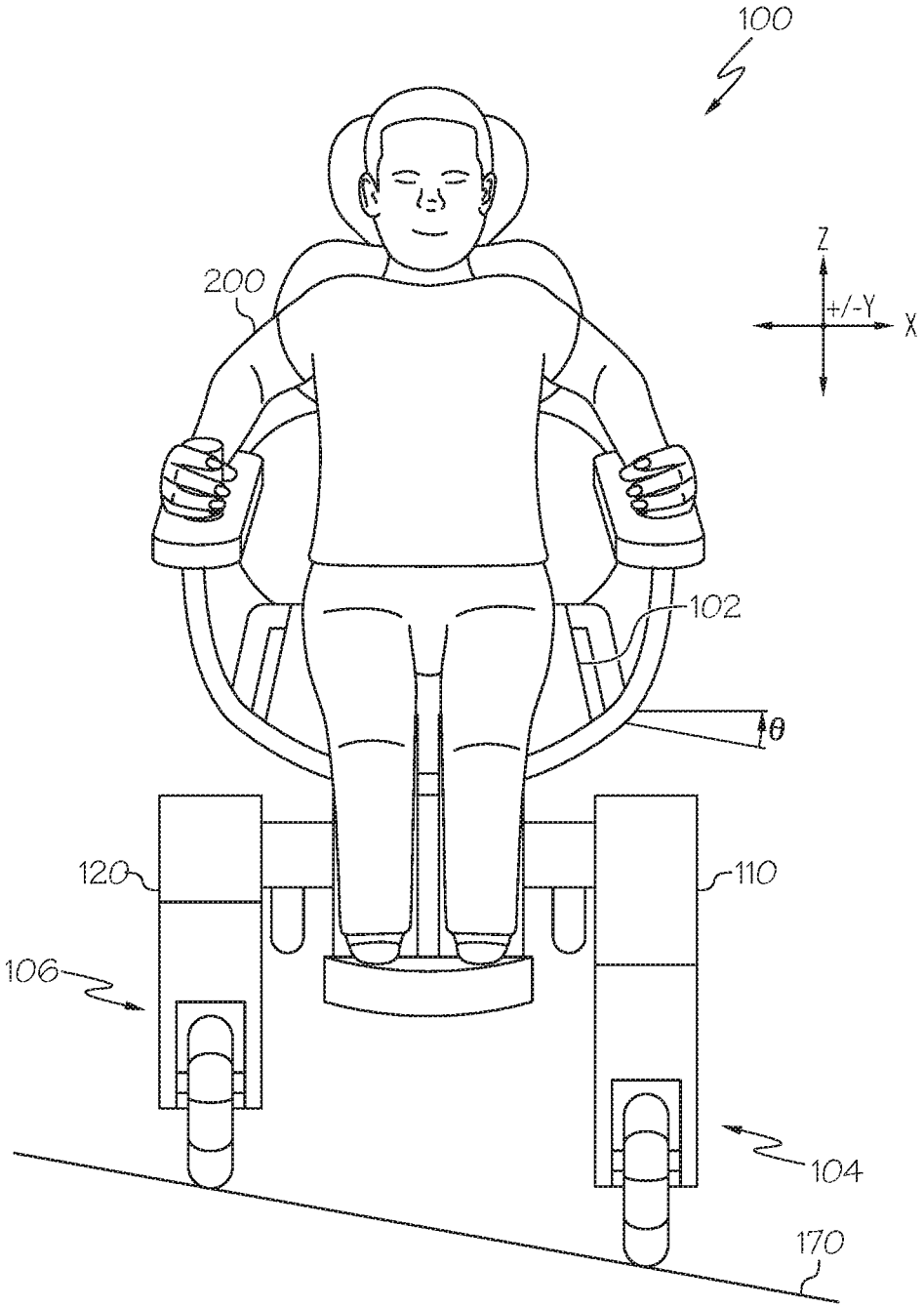
FIG. 3A depicts a front view of a wheelchair user making a turning motion, according to one or more embodiments shown and described herein.
Figure 3B:
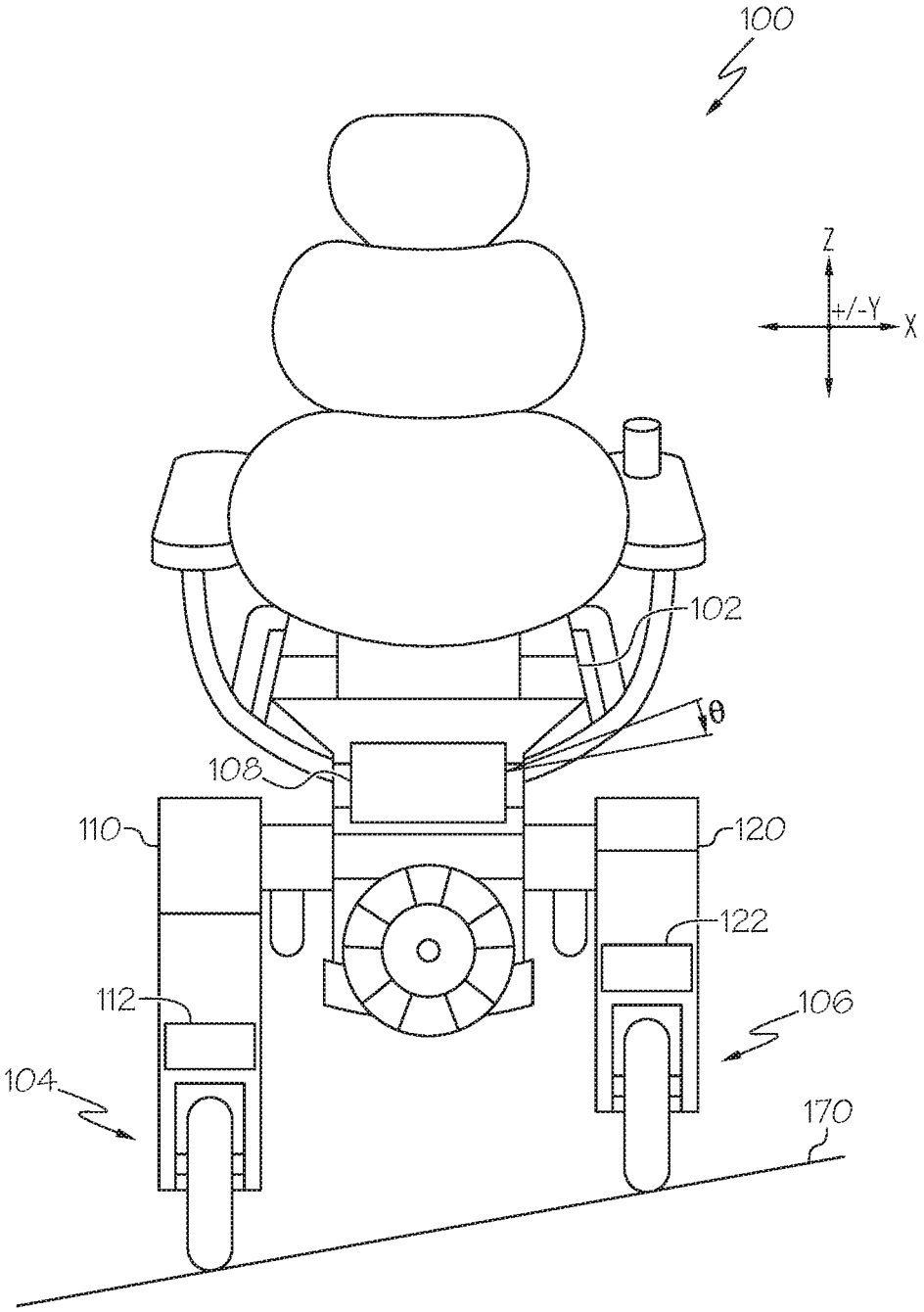
FIG. 3B depicts a back view of the wheelchair of FIG. 3A, according to one or more embodiments shown and described herein.
Figure 3C:
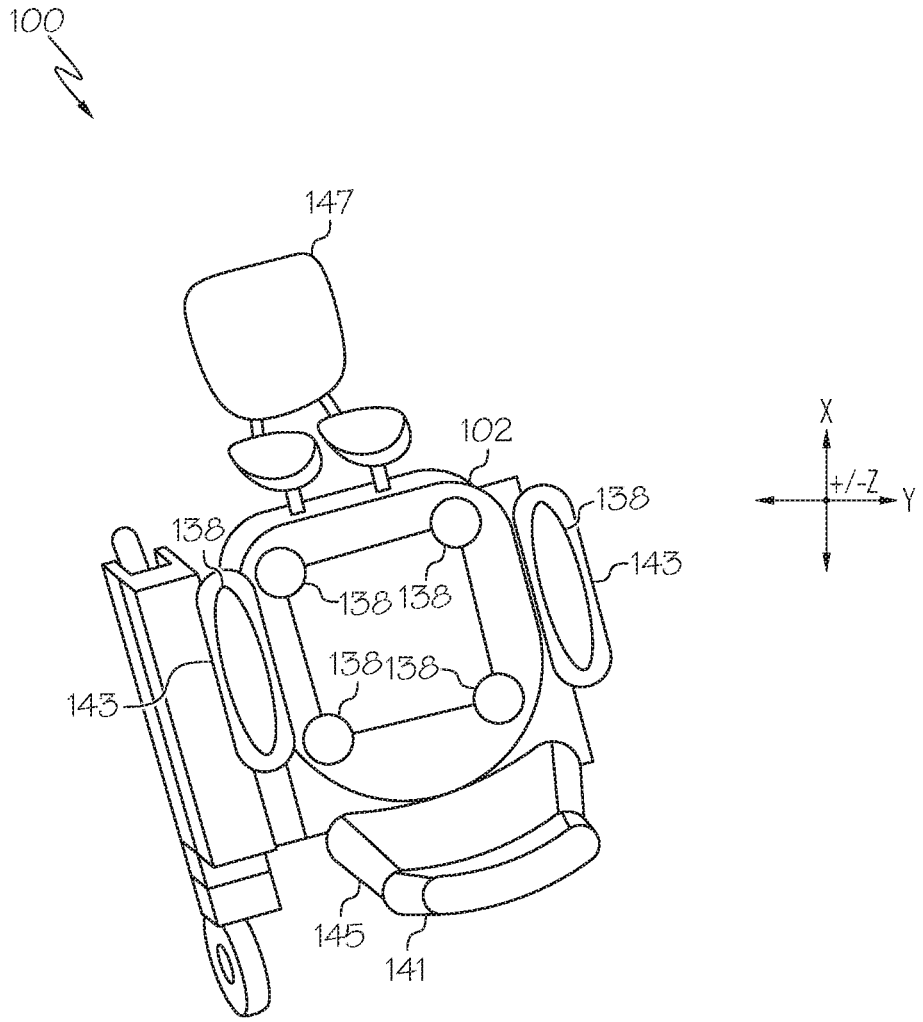
FIG. 3C depicts a top view of the wheelchair of FIG. 3A without the user, according to one or more embodiments shown and described herein.

FIGS. 3A-3C illustrate a powered wheelchair 100 traveling over an uneven surface 170. FIG. 3A depicts a front view of the powered wheelchair 100 with a user 200 positioned within the seat. FIG. 3B depicts a back view of the powered wheelchair 100 with the user 200 removed. FIG. 3C depicts a top or aerial view of the powered wheelchair 100 with the user 200 removed.

Referring to FIG. 3B, the first inertial measurement unit 112 may be mounted to or within the first leg 110 of the powered wheelchair 100 and the second inertial measurement unit 122 may be mounted to or within the second leg 120 of the powered wheelchair 100. The control unit 140 may receive a signal from the first inertial measurement unit 112 to determine the position of the first leg 110 of the powered wheelchair. The control unit 140 may further receive a signal from the second inertial measurement unit 122 to determine the position of the second leg 120. Accordingly, the control unit 140 may determine a global orientation of the powered wheelchair by averaging the position of the first leg 110 provided by the first inertial measurement unit 112 and the position of the second leg 120 provided by the second inertial measurement unit 122. Based on the determination of the global orientation of the powered wheelchair 100, the control unit may automatically adjust the position of the first leg 110 and the position of the second leg 120 with the first and second leg actuators 114, 124, respectively, such that the seat 102 may be maintained in a pre-selected position, regardless of the pitch or tilt of the uneven surface 170.

In embodiments, the control unit 140 determines the global orientation of the powered wheelchair 100 by aggregating tilt (e.g., forward tilt) data and roll (e.g., lateral tilt) data provided by the first inertial measurement unit 112 and the second inertial measurement unit 122. The seat 102 may further include a third inertial measurement unit 108 configured to confirm that the seat 102 may be being maintained in the pre-selected position. If the third inertial measurement unit 108 senses that the seat 102 is not maintained in the pre-selected position, the third inertial measurement unit 108 may command the control unit 140 to stop movement of the powered wheelchair 100 or provide a signal to the user 200 that the powered wheelchair is not functioning properly and/or is in need of servicing.

In one or more embodiments, the first leg actuator 114 may be configured to adjust at least one of a height, a pitch, and a roll of the first leg 100. Likewise, the second leg actuator 124 may be configured to adjust at least one of a height, a pitch, and a roll of the second leg 120. Together, the first and second leg actuators 114, 124 may maintain the seat 102 in the pre-selected position, regardless of tilt or pitch of the uneven surface 170. For example, the user 200 may define a pre-selected position for the seat 102 at 0.6 meters (m). The relationship between the pre-selected position (0.6 m) and hip and knee angles of the user 200 may be defined by Equation (1):

$$H(h) = \left(\frac{1}{\alpha}\right)(h - \beta) \qquad \text{Equation (1)}$$

where $\alpha$ and $\beta$ are representative constants selected by the manufacturer of the powered wheelchair 100. As a non-limiting example, $\alpha$=0.0102 and $\beta$=0.3456, such that H(0.6)=~25°. In other words, the first and second leg actuators 114, 124 maintain the first and second legs 110, 120 at an offset of 25°.

In a first example, assume that the user 200 is traveling in the powered wheelchair 100 over an uneven surface with a pitch angle of −10° and a roll angle of 0°. In this scenario, the first internal measurement unit 112 may measure a $\text{Pitch}_1$ of −10° and a Roll' of 0° for the first leg 110 of the powered wheelchair 100. Likewise, the second internal measurement unit 122 may measure a $\text{Pitch}_2$ of −10° and a $\text{Roll}_2$ of 0° for the second leg 120 of the powered wheelchair 100. This pitch and roll data may be then sent to the control unit 140 which may be capable of determining the global position of the powered wheelchair 100 with Equations (2) and (3):

$$P = \frac{\text{Pitch1} + \text{Pitch2}}{2} = \frac{-10 - 10}{2} = -10° \qquad \text{Equation (2)}$$

$$R = \frac{\text{Roll1} + \text{Roll2}}{2} = \frac{0 + 0}{2} = 0° \qquad \text{Equation (3)}$$

Based on this determination, the control unit 140 may command the first and second leg actuators 114, 124 to provide a pitch correction of −10° to the seat 102, which accounts for the pitch angle of the uneven surface, by adjusting the first and second legs 110, 120, respectively, to maintain the seat 102 in the pre-selected position.

In a second example, assume that the user 200 is traveling in the powered wheelchair 100 over an uneven surface with a roll angle of −5° and a pitch angle of 0°. In this scenario, the first internal measurement unit 112 measures a $\text{Pitch}_1$ of 0° and a Roll' of −5° for the first leg 110 of the powered wheelchair 100. Likewise, the second internal measurement unit 122 measures a $\text{Pitch}_2$ of 0° and a $\text{Roll}_2$ of −5° for the second leg 120 of the powered wheelchair 100. This pitch and roll data may be sent to the control unit 140 which may be capable of determining the global position of the powered wheelchair 100 with Equations (2) and (3):

$$P = \frac{\text{Pitch1} + \text{Pitch2}}{2} = \frac{0 + 0}{2} = 0° \qquad \text{Equation (2)}$$

$$R = \frac{\text{Roll1} + \text{Roll2}}{2} = \frac{-5 - 5}{2} = -5° \qquad \text{Equation (3)}$$

Based on this determination, the control unit 140 may command the first and second leg actuators 114, 124 to provide a roll correction of −5° to the seat 102, which accounts for the pitch angle and roll angles of the uneven surface, by adjusting the first and second legs 110, 120, respectively, to maintain the seat 102 in the pre-selected position.

In a third example, assume that the user 200 is traveling in the powered wheelchair 100 over an uneven surface with a pitch angle and a roll angle that is different for each of the first and second legs 110, 120. In this scenario, the first internal measurement unit 112 may measure a $\text{Pitch}_1$ of −10° and a $\text{Roll}_1$ of −4° for the first leg 110 of the powered wheelchair 100. Likewise, the second internal measurement unit 122 may measure a $\text{Pitch}_2$ of −6° and a $\text{Roll}_2$ of −8° for the second leg 120 of the powered wheelchair 100. This pitch and roll data may be sent to the control unit 140 which may be capable of determining the global position of the powered wheelchair 100 with Equations (2) and (3):

$$P = \frac{\text{Pitch1} + \text{Pitch2}}{2} = \frac{-10-6}{2} = -8^\circ \quad \text{Equation (2)}$$

$$R = \frac{\text{Roll1} + \text{Roll2}}{2} = \frac{-4-8}{2} = -6^\circ \quad \text{Equation (3)}$$

Based on this determination, the control unit 140 may command the first and second leg actuators 114, 124 to provide a pitch correction of −8° and a roll correction of −5° to the seat 102, which accounts for the pitch and roll angles of the uneven surface, by adjusting the first and second legs 110, 120, respectively, to maintain the seat 102 in the pre-selected position.

Referring to FIG. 3C, the one or more force sensors 138 may be mounted to one or more of the seat 102, a headrest 141, arm rests 143, a back support 145, a lower leg and foot rest 147, or any combination thereof and output a force signal. The control unit 140 may receive the force signal of the one of the one or more force sensors 138 to determine the center of gravity of the user 200 and/or determinate how the user 200 is sitting in the chair (e.g., leaning forward, reclining, leaning on the arm rests 143, etc.). Accordingly, the control unit 140 may also detect changes in the user's 200 posture or center of gravity based on the one or more force sensors 138. In embodiments, changes to the user's 200 posture or center of gravity may cause the control unit 140 to operate the first leg actuator 114, the second leg actuator 124, the seat actuator 134, or any combination thereof, to adjust the user's posture or center of gravity to a preferred position (e.g., the center of the seat 102 or some other pre-selected position).

The pre-selected position of the seat 102 of the powered wheelchair 100 may be based on one or more factors including but not limited to, a predetermined leaning constant, the speed and/or acceleration of the powered wheelchair 100, a body morphology of the user 200, characteristics of the powered wheelchair 100 (e.g., height, weight, etc.), and/or one or more user preferences. For example, the pre-selected position of the seat 102 may be a predetermined angle θ relative to a horizontal plane. In embodiments, the pre-selected position of the seat 102 may be a substantially horizontal position. For example, the seat 102 may be maintained within 5° of the pre-selected position (e.g., the substantially horizontal position).

It is noted that the speed and/or acceleration (or deceleration) of the powered wheelchair 100 may also affect the position of the seat 102. Accordingly, in some embodiments, the inertial measurement units 112, 122 may be configured to output an acceleration and/or speed signal indicative of the acceleration and/or speed of the powered wheelchair 100. Based on the speed or acceleration signal, the control unit 140 may determine a speed or acceleration of the powered wheelchair 100. In some embodiments, the control unit 140 may the adjust the first leg 110 (e.g., with the first leg actuator 114) and/or the second leg 120 (e.g., with the second leg actuator 124) based on the speed or acceleration of the powered wheelchair 100.

As noted herein, user information, preference information, or the like may be communicated to control unit 140 using the one or more user interface devices 160. That is the one or more user interface devices 160 may be communicatively coupled to the control unit 140 over the communication path 130. The one or more user interface devices 160 may include any combinations of joysticks, knobs, buttons, touchscreens, keyboards, microphones, or the like, which allow the user 200 to interact with the control unit 140. As noted above, the user 200 may indicate via the one or more user interface devices 160 one or more preferences (e.g., posture preferences, leaning preferences, or the like) which may be used in determining the pre-selected position of the seat 102. In some embodiments, the user 200 may provide information regarding the user's body morphology (e.g., weight, height, missing limbs, etc.) to allow the control unit 140 to tune calculations of the pre-selected position to the user's particular body characteristics. Accordingly, the control unit 140 may receive the one or more user preferences and/or characteristic information from the one or more user interface devices 160 and tailor the pre-selected position of the seat 102 based on the user's preferences and/or the user's characteristic information.

A method for maintaining a seat of the powered wheelchair 100 in a pre-selected position is also described below. It is noted that while a number of steps are described, a fewer or greater number of steps, in any order, may be included.

The method may include receiving, with the control unit 140, a position of the first leg 110 as determined by the first inertial measurement unit 112 and a position of the second leg 120 a determined by the second inertial measurement unit 122. The method may further include determining, with the control unit 140, a global orientation of the powered wheelchair 100 by averaging the position of first leg 110 provided by the first inertial measurement unit 110 and the position of the second leg 120 provided by the second inertial measurement unit 122. The method may further include automatically adjusting, with the control unit 140, at least one of the first leg 110 of the powered wheelchair 100 and the second leg 120 of the powered wheelchair 100 to maintain the seat 102 in the pre-selected position. The method may further include confirming the pre-selected position of the seat 102 with a third inertial measurement unit 108. Accordingly, the control unit 140 may dynamically respond to changes in the position of the first leg 100 and/or the second leg 120 caused by traversing an uneven surface 170 to maintain the seat 102 in the pre-selected position.

It should now be understood that embodiments of the present disclosure are directed to powered wheelchairs and methods for maintaining a seat of a powered wheelchair in a pre-selected position. For example, when a powered wheelchair is traversing uneven terrain, the seat of the powered wheelchair may tilt. The tilting may influence a user's center of gravity that may result in overturning of the powered wheelchair. Embodiments of the present disclosure, therefore, are configured to determine the position of the legs of the powered wheelchair and further to determine a global orientation of the powered wheelchair by averaging the position of the first leg provided by a first inertial measurement unit and the position of the second leg provided by the inertial measurement unit. Based on determining the global orientation of the powered wheelchair, the position of the first leg and the position of the second leg may be automatically adjusted such that the powered wheelchair's seat is maintained in a pre-selected (e.g., substantially horizontal) position). The pre-selected position may also take into account for various factors, which may be inputted by a user of the powered wheelchair with a user interface device.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A powered wheelchair comprising:

a seat;

a first leg located at a first side of the powered wheelchair, the first leg comprising a first inertial measurement unit configured to determine a position of the first leg and a first leg actuator configured to adjust a position of the first leg;

a second leg located at a second side of the powered wheelchair, the second leg comprising a second inertial measurement unit configured to determine a position of the second leg and a second leg actuator configured to adjust a position of the second leg; and a control unit operable to:

determine a global orientation of the powered wheelchair by averaging the position of the first leg provided by the first inertial measurement unit and the position of the second leg provided by the second inertial measurement unit; and automatically adjust the position of the first leg with the first leg actuator and the position of the second leg with the second leg actuator based on the global orientation of the powered wheelchair such that the seat is maintained in a pre-selected position.

2. The powered wheelchair of claim 1, further comprising a third inertial measurement unit configured to confirm that the seat is being maintained in the pre-selected position.

3. The powered wheelchair of claim 1, wherein the third inertial measurement unit is located at the seat of the powered wheelchair.

4. The powered wheelchair of claim 1, wherein the control unit determines the global orientation of the powered wheelchair by aggregating forward tilt data and lateral tilt data provided by the first inertial measurement unit and the second inertial measurement unit.

5. The powered wheelchair of claim 1, further comprising a user interface device communicatively coupled to the control unit, wherein the control unit is configured to receive one or more user preferences with the user interface device, the one or more user preferences comprising at least the pre-selected position.

6. The powered wheelchair of claim 5, wherein the pre-selected position is such that the seat is in a substantially horizontal position.

7. The powered wheelchair of claim 1, wherein the seat is maintained within 5° of the pre-selected position.

8. The powered wheelchair of claim 1, further comprising one or more force sensors configured to cause the control unit to operate the first leg actuator, the second leg actuator, a seat actuator, or any combination thereof to maintain the seat in the pre-selected position.

9. The powered wheelchair of claim 1, wherein:

the first leg actuator is configured to adjust at least one of a height, a pitch, and a roll of the first leg; and the second leg actuator is configured to adjust at least one of a height, a pitch, and a roll of the second leg.

10. The powered wheelchair of claim 1, wherein:

the control unit is operable to determine an acceleration of the powered wheelchair based on an acceleration signal of the first inertial measurement unit, the second inertial measurement unit, or both the first inertial measurement unit and the second inertial measurement unit; and the pre-selected position is based on the acceleration of the wheelchair.

11. A method for maintaining a seat of a powered wheelchair in a pre-selected position, the method comprising:

receiving, with a control unit, a position of a first leg located at a first side of the powered wheelchair as determined by a first inertial measurement unit;

receiving, with the control unit, a position of a second leg located at a second side of the powered wheelchair as determined by a second inertial measurement unit;

determining, with the control unit, a global orientation of the powered wheelchair by averaging the position of first leg provided by the first inertial measurement unit and the position of the second leg provided by the second inertial measurement unit; and automatically adjusting, with the control unit, at least one of the first leg of the powered wheelchair and the second leg of the powered wheelchair with one or more actuators to maintain the seat in the pre-selected position.

12. The method of claim 11, further comprising confirming the pre-selected position of the seat with a third inertial measurement unit.

13. The method of claim 12, wherein the third inertial measurement unit is located at the seat of the powered wheelchair.

14. The method of claim 11, wherein determining the global orientation of the powered wheelchair comprises aggregating, with the control unit, forward tilt data and lateral tilt data provided by the first inertial measurement unit and the second inertial measurement unit.

15. The method of claim 11, further comprising receiving, with the control unit, one or more user preferences from one or more user interface devices, the one or more user preferences comprising at least the pre-selected position.

16. The method of claim 15, wherein the pre-selected position is such that the seat is in a substantially horizontal position.

17. The method of claim 11, wherein the seat is maintained within 5° of the pre-selected position.

18. The method of claim 11, wherein the powered wheelchair comprises one or more force sensors configured to cause the control unit to operate the first leg actuator, the second leg actuator, a seat actuator, or any combination thereof to maintain the seat in the pre-selected position.

19. The method of claim 18, wherein:

the first leg actuator is configured to adjust at least one of a height, a pitch, and a roll of the first leg; and the second leg actuator is configured to adjust at least one of a height, a pitch, and a roll of the second leg.

20. The method of claim 11, further comprising:

receiving, with the control unit, an acceleration signal from the first inertial measurement unit, the second inertial measurement unit, or both the first inertial measurement unit and the second inertial measurement unit; and determining an acceleration of the powered wheelchair based on the acceleration signal, wherein the pre-selected position is based on the acceleration of the wheelchair.

* * * * *